US011242721B2

(12) United States Patent
Rønne et al.

(10) Patent No.: US 11,242,721 B2
(45) Date of Patent: Feb. 8, 2022

(54) LARGE BORE OPEN WATER LUBRICATOR

(71) Applicant: FMC Technologies, Inc., Houston, TX (US)

(72) Inventors: Simen Christian Florus Rønne, Houston, TX (US); Kok Keong Joseph Lim, Houston, TX (US); Wei Ting Anderson Chua, Houston, TX (US); Ole Eddie Karlsen, Houston, TX (US); Luis Felipe, Houston, TX (US); H. Brian Skeels, Houston, TX (US); Vidar Sten-Halvorsen, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 76 days.

(21) Appl. No.: 16/635,611

(22) PCT Filed: Aug. 1, 2017

(86) PCT No.: PCT/US2017/044929

§ 371 (c)(1),
(2) Date: Jan. 31, 2020

(87) PCT Pub. No.: WO2019/027448

PCT Pub. Date: Feb. 7, 2019

(65) Prior Publication Data

US 2020/0240229 A1 Jul. 30, 2020

(51) Int. Cl.

| | |
|---|---|
| ***E21B 33/038*** | (2006.01) |
| ***E21B 33/076*** | (2006.01) |
| ***E21B 29/12*** | (2006.01) |
| ***E21B 43/013*** | (2006.01) |
| ***E21B 43/017*** | (2006.01) |

(52) U.S. Cl.
CPC ..... *E21B 33/038* (2013.01); *E21B 33/076* (2013.01)

(58) Field of Classification Search
None
See application file for complete search history.

(56) References Cited

U.S. PATENT DOCUMENTS

| | | | | |
|---|---|---|---|---|
| 4,127,167 A * | 11/1978 | Arendt | E21B 33/037 166/381 |
| 6,763,889 B2 * | 7/2004 | Rytlewski | E21B 47/00 166/338 |
| 7,063,157 B2 * | 6/2006 | Bartlett | E21B 23/00 166/339 |
| 8,857,520 B2 * | 10/2014 | Hoffman | E21B 33/038 166/351 |

(Continued)

*Primary Examiner* — Matthew Troutman
*Assistant Examiner* — Douglas S Wood
(74) *Attorney, Agent, or Firm* — Osha Bergman Watanabe & Burton LLP

(57) ABSTRACT

A system is provided to perform various wellbore operations, including retrieval and replacement of solid internal tree caps, for example. The system may include an open water lubricator having a piston assembly disposed therein. The system may also include a well control package connected to a distal end of the open water lubricator. The piston assembly is configured to extend through the well control package. Method using systems disclosed herein may be performed while maintaining at least two testable pressure barriers during each of the retrieving and replacement steps.

24 Claims, 8 Drawing Sheets

(56) References Cited

U.S. PATENT DOCUMENTS

| | | | | |
|---|---|---|---|---|
| 2002/0139535 | A1* | 10/2002 | Nice | E21B 33/076<br>166/344 |
| 2006/0124314 | A1* | 6/2006 | Haheim | E21B 33/072<br>166/368 |
| 2006/0125314 | A1* | 6/2006 | Hashiba | B60T 17/02<br>303/113.1 |

* cited by examiner

LARGE BORE OPEN WATER LUBRICATOR

BACKGROUND

Subsea Christmas trees, both horizontal and vertical, may feature isolation devices such as tubing hanger crown plugs and internal tree caps with large drift diameters. In some embodiments, the outer diameter of an internal tree cap may be as large as 18.5 inches or more.

An internal tree cap may have a solid body, may include a ball valve, or may include an access bore which may hold a receptacle for an upper crown plug. Gaining access to a well topped by a Christmas tree having a solid body internal tree cap requires completely removing the internal tree cap. Solid body internal tree caps must be retrieved within a pressure containing/pressure balanced environment to maintain multiple well control barriers. Access to a wellbore for Christmas trees including a solid body internal tree cap may require use of a subsea blowout preventer and a drilling riser deployed from a large drill ship or a semi-submersible. The blowout preventer may have an internal diameter of 18¾ inches and the drilling riser may have an internal diameter of nineteen inches, for example.

In contrast, an internal tree cap having an access bore may be left in place in the Christmas tree while access to the well is gained by pulling the upper crown plug disposed in the receptacle. A crown plug may also be pulled from the tubing hanger. The crown plug may be able to be pulled using a completion workover riser or a riserless light well intervention system, which may also be used to perform a desired wellbore intervention. The cost of deploying a completion workover riser or a riserless light well intervention system may be significantly lower than the cost of deploying a blow-out preventer and a drilling riser.

Therefore, it may be desired to replace solid body internal tree caps with internal tree caps having access bores.

SUMMARY OF THE DISCLOSURE

In one aspect, this disclosure relates to a system for performing wellbore operations. The system may include an open water lubricator having a piston assembly disposed therein. The system may also include a well control package connected to a distal end of the open water lubricator. The piston assembly is configured to extend through the well control package, such as into a Christmas tree or other portions of a wellbore to perform a wellbore operation.

The piston assembly may be connected to a running tool configured to engage with a wellbore element, such as at least one of an internal tree cap and a crown plug. The interior of the system may also include at least one verifiable (testable) pressure barrier.

In some embodiments, the open water lubricator may include an upper assembly and a lower spool assembly. The upper assembly may include a tell-tale assembly and a linear actuator assembly connected to the tell-tale assembly. The lower spool assembly may be connected to the linear actuator assembly.

The tell-tale assembly may include: a housing, a tell-tale rod disposed within the housing, a rotary actuator configured to rotate the piston assembly and/or a running tool, and a hose management system. The upper assembly may include internal and/or external hydraulic lines and a hydraulic manifold may be configured for one or more of providing movement of the tell-tale rod or actuating a running tool connected directly or indirectly to the tell-tale rod.

The linear actuator assembly may include: a linear actuator housing, a piston disposed within the actuator housing and connected to a lower end of the tell-tale rod, a piston stem connected to the piston, the piston stem extending into the lower spool assembly. The lower spool assembly may be configured to be connected to a subsea Christmas tree or the well control package. The well control package may include at least one valve configured to seal a central bore of the system.

In another aspect, this disclosure relates to a method of performing a wellbore operation. The method may include engaging a cap replacement system with a subsea Christmas tree. The cap replacement system may include: an open water lubricator having a piston disposed therein; and a well control package connected to a distal end of the open water lubricator. Once connected to the Christmas tree, a first internal tree cap may be withdrawn from the subsea Christmas tree into the open water lubricator. A valve in the well control package may then be closed. The open water lubricator, containing the piston and the first internal tree cap, may be disengaged from the Christmas tree, and the first internal tree cap may be removed from the open water lubricator. A second internal tree cap may be installed in the open water lubricator, and then the open water lubricator is re-connected to the well control package. The valve in the well control package is opened, and the second internal tree cap is disposed within the subsea Christmas tree. Following installation of the second cap, the open water lubricator and the well control package may be removed from the subsea Christmas tree.

The step of withdrawing a first internal tree cap from the subsea Christmas tree into the open water lubricator may include: extending the piston into the subsea Christmas tree; engaging a running tool connected to the piston with a first internal tree cap; removing the first internal tree cap from the subsea Christmas tree; and retracting the piston, the running tool, and the first internal tree cap into the open water lubricator.

The step of disposing the second internal tree cap within the subsea Christmas tree may include: extending the piston and a running tool with the second internal tree cap disposed thereon into the subsea Christmas tree; installing the second internal tree cap in the subsea Christmas tree; disengaging the running tool from the second internal tree cap; and retracting the piston into the open water lubricator.

The method may also include disconnecting the cap replacement system from a vessel and performing at least part of the operation while the cap replacement system is not connected to the vessel. A seal verification test on the internal tree cap, the cap replacement system, and optionally, a lower crown plug disposed in the wellhead, may be performed at various steps during the process, verifying the desired seals have been made.

The method may also include performing a wellbore operation after removing the first internal tree cap. The wellbore operation may include: engaging a riserless light well intervention stack with the well control package; opening the valve in the well control package; retrieving a lower crown plug disposed in the subsea Christmas tree; performing a wellbore intervention; replacing the lower crown plug; closing the valve in the well control package; and removing the riserless light well intervention stack.

In some embodiments, the first internal tree cap may be a solid body internal tree cap and the second internal tree cap may be an internal tree cap which includes an access bore formed therethrough.

The method may also include performing a wellbore operation after disposing the second internal tree cap in the subsea Christmas tree. The wellbore operation may include: engaging a riserless light well intervention stack with the well control package; opening the valve in the well control package; retrieving a lower crown plug disposed in the subsea Christmas tree; performing a wellbore intervention; replacing the lower crown plug; installing a crown plug in the second internal tree cap; closing the valve in the well control package; and removing the riserless light well intervention stack from the well control package.

The method may also include performing a seal verification test on one or more of the internal tree cap, the cap replacement system, the valve, and a lower crown plug disposed in the wellhead. The method may further include maintaining at least two verifiable pressure barriers throughout the wellbore operation.

In another aspect, this disclosure relates to an open water lubricator. The open water lubricator may include: an upper assembly comprising an outer housing; a lower spool assembly connected to the linear actuator assembly; and a piston assembly at least partially disposed within the upper assembly and the lower spool assembly.

The piston assembly may include: a piston disposed within the outer housing of the upper assembly; and a piston stem connected to the piston, the piston stem extending into the lower spool assembly. The piston assembly may be configured to linearly translate the piston within the outer housing and to translate the piston stem through the lower spool assembly.

The upper assembly may further include a tell-tale assembly connected to the piston assembly. The tell-tale assembly may be configured to provide rotary actuation/movement, such as rotation of the piston assembly and/or a tool connected to the piston assembly. The tell-tale assembly may include: a housing, a tell-tale rod disposed within the housing, a rotary actuator configured to rotate the piston assembly and/or running tool, and a hose management system.

The upper assembly further may also include internal and/or external hydraulic lines and a hydraulic manifold may be configured for one or more methods of providing linear translation of the piston assembly, movement of the tell-tale rod, or actuation of a running tool connected directly or indirectly to the tell-tale rod or the piston stem.

Other aspects and advantages will be apparent from the following description and the appended claims.

DETAILED DESCRIPTION

Figure 1:
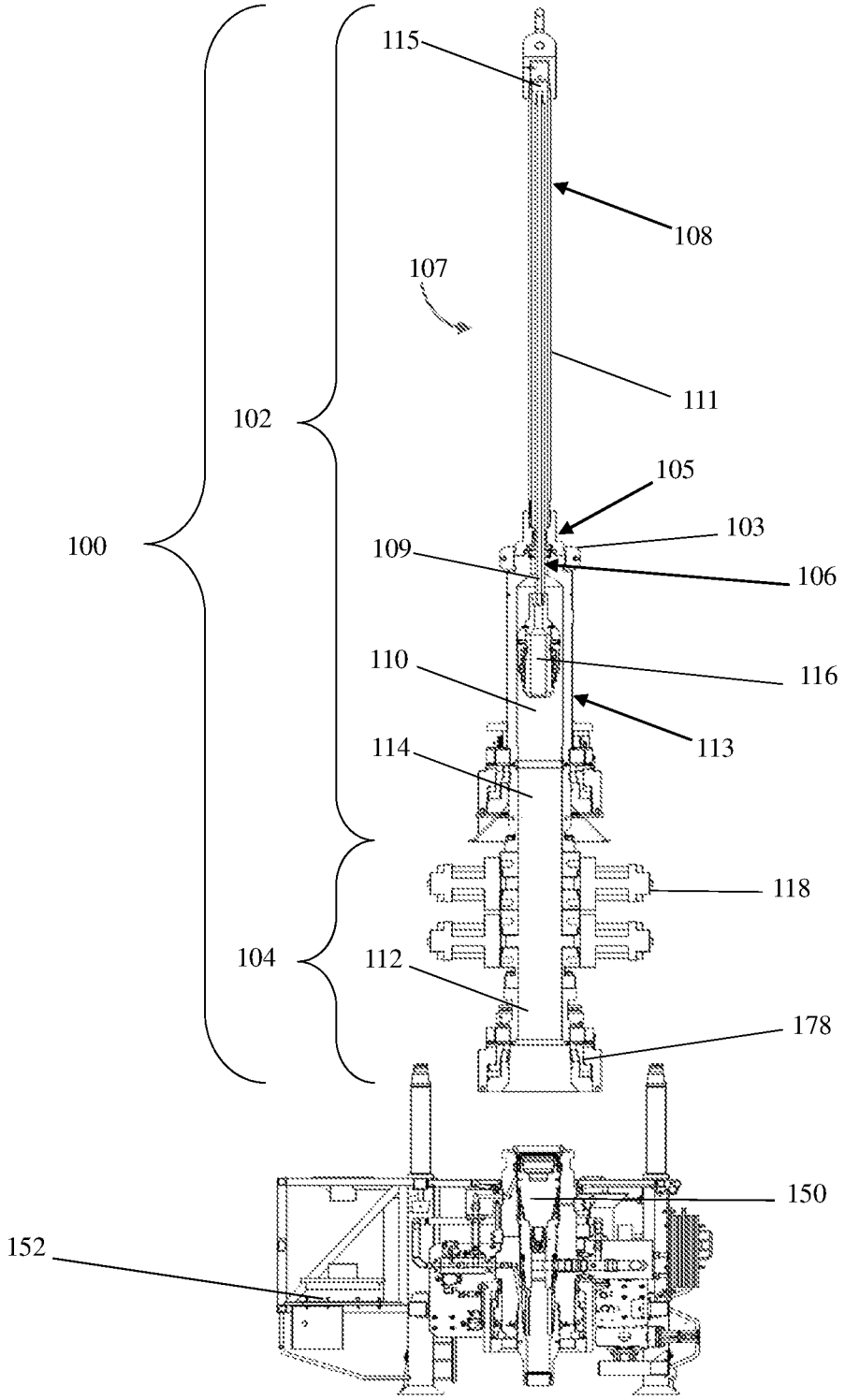
FIG. 1 is a schematic view of a cap replacement system in accordance with the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

In one aspect, this disclosure relates to a system for accessing elements disposed within a Christmas tree. The system may be configured to remove, install, and/or replace an internal tree cap. The system may be referred to as a cap replacement system herein. However, the system could be used to install, remove, or replace other elements from a subsea Christmas tree or wellhead without departure from the scope of the present disclosure.

FIG. 1 illustrates a cap replacement system 100. The cap replacement system 100 may include an open water lubricator 102 and a well control package 104. The well control package 104 may be attached to a distal end of the open water lubricator 102.

The open water lubricator 102 may include a central lubricator bore 110 and the well control package 104 may include a central package bore 112. The central lubricator bore 110 and the central package bore 112 may be concentric and may have the same outer diameter, such that the central lubricator bore 110 and the central package bore 112 form a single central bore 114 extending through the cap replacement system 100. The open water lubricator 102 and the well control package 104 may be pressure containing bodies. The cap replacement system 100 may be capable of containing pressure within the central bore 114, and may include one or more seals, such as a seal 105 internal to bonnet/connection 103, which may seal around piston stem 109, for example.

The well control package 104 may be any type of well control package known in the art. In some embodiments, the well control package 104 may be a two-ram well control package. The well control package 104 may include a valve 118 which is capable of closing the central bore 114 and preventing the flow of fluid therethrough. The valve 118 may be any type of valve known in the art which is capable of withstanding operating pressures and temperatures and complying with standard regulations. In some embodiments, the valve 118 may be a blind shear ram. The well control package 104 may include a connector 178 which is configured to attach to a subsea Christmas tree 152 or other subsea wellhead element.

The open water lubricator 102 may include an upper assembly 107 coupled to a spool assembly 113. As noted above, the central bore 114 of the open water lubricator 102 may include bores 110, 112, thus at least partially residing within the spool assembly 113. The open water lubricator 102 may further include a piston assembly 106 that is at least partially disposed within the spool assembly 113 and the upper assembly 107. Piston assembly 106 may include, among other components, at least one actuation or control mechanism, a piston 115 and a piston stem 109.

The upper assembly 107 may include an outer housing 111. In the embodiment shown, there is at least one actuation or control mechanism that comprises a linear actuator 108 at least partially located within the outer housing 111 of the upper assembly 107. It should be appreciated that other actuation or control mechanisms associated with the piston assembly 106 can be incorporated into the open water lubricator 102 and/or the upper assembly 107 of the open water lubricator 102 depending upon the intended functionality of the piston assembly, as will be described below. The linear actuator 108 may extend and retract the piston assembly 106 vertically. The linear actuator 108 may be any type of actuator known in the art. For example, the actuator 108 may be a hydraulic actuator or a mechanical actuator. A hydraulic actuator 108 may include, for example, hydraulic lines, seals and pistons (not illustrated) configured to move piston 115 within housing 111, thereby extending and retracting the piston assembly 106 through spool assembly 113 and well control package 104 as required to perform the desired operations.

In some embodiments, the cap replacement system 100 may include an intensifier device (not shown) which may be capable of pulling or pushing the piston assembly 106 with more force than the actuator 108 is capable of providing by multiplying the linear force produced by the actuator 108.

The piston assembly 106 may have a fully retracted configuration and a fully extended configuration. When the piston assembly 106 is in the fully retracted configuration, the piston assembly 106 may be located entirely within the open water lubricator 102. When the piston is in the fully extended configuration, at least a portion of the piston assembly 106 may extend through the well control package 104 and a distal end of the piston assembly 106 may extend beyond a lower end of the well control package 104.

A running tool 116 may be attached to the distal end of the piston assembly 106. The running tool 116 may be configured to engage with an internal tree cap 150 or with another element or tool (not shown) that may be operated, removed from or installed in a subsea Christmas tree 152 or a wellhead or wellbore (not shown). The running tool 116 may include a latch (not shown) which may engage and disengage from the internal tree cap 150. The latch may be capable of engaging with the body and lockdown sleeves or dogs of the internal tree cap 150.

The latch may function by any means known in the art. In some embodiments, for example, the latch may be a mechanism by which rotating the piston assembly 106 and/or running tool 116 in a first direction engages the running tool 116 with the internal tree cap 150 and rotating the piston assembly 106 and/or running tool 116 in a second direction disengages the running tool 116 from the internal tree cap 150. In some embodiments, the latch may grip protruding portions of the internal tree cap 150. In some embodiments, the latch may be hydraulically controlled remotely or controlled by a remote operated vehicle (ROV).

Figure 2A:
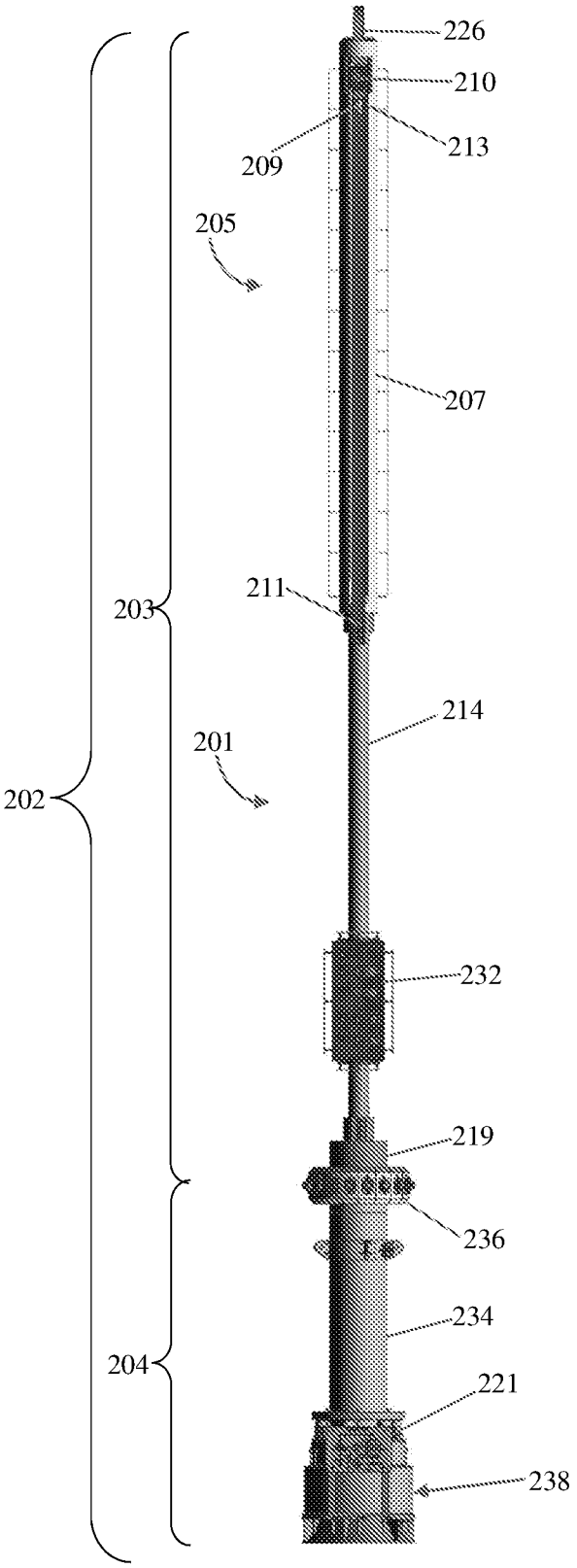
FIG. 2*a* is a perspective view of an open water lubricator in accordance with the present disclosure.
Figure 2B:
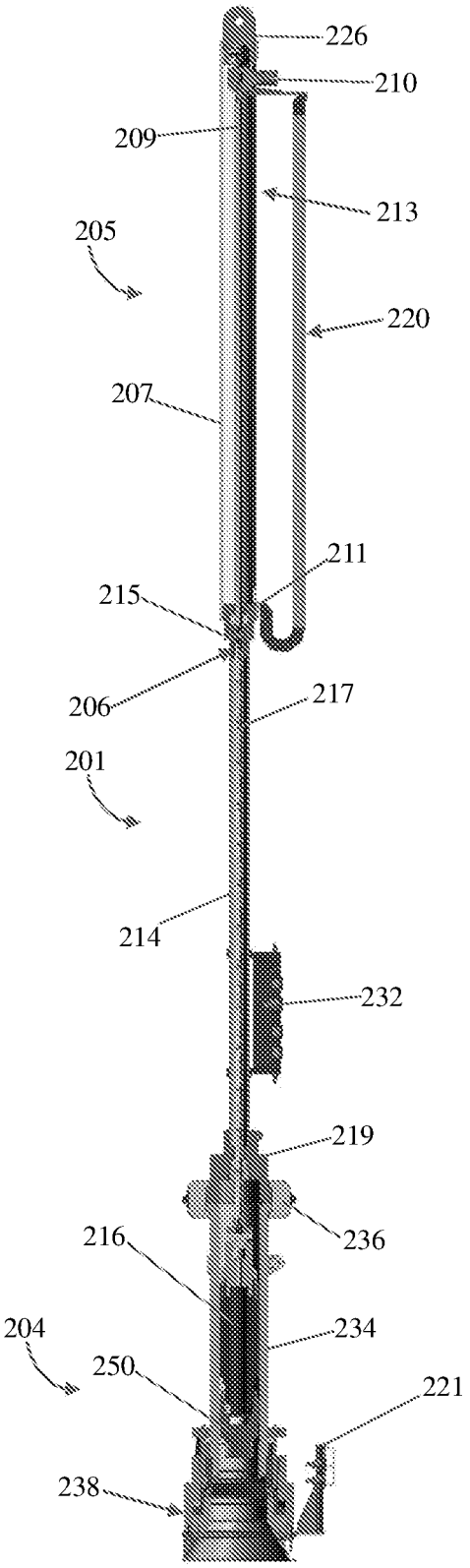
FIG. 2*b* is a cross-section view of an open water lubricator in accordance with the present disclosure.

In certain embodiments, the open water lubricator 102 may include actuation and/or control mechanisms that control the functionality of the piston assembly 106 and/or running tool 116 in order to engage with the internal tree cap. FIGS. 2*a* and 2*b*, for instance, illustrate an example open water lubricator 202. Open water lubricator 202 may include an upper assembly 203 and a spool assembly 204, and in which the upper assembly 203 comprises a linear actuator 201 that operates similarly to the linear actuator described in FIG. 1, as well as a tell-tale assembly 205 that may provide additional control functionality, as described below. An upper end of the tell-tale assembly 205 may terminate at a lifting point 226.

Tell-tale assembly 205 may include, among other components not labeled, a tell-tale housing 207 within which is a tell-tale rod 209, a rotary actuator 210, a housing adapter 211, and a hose management system 220. Tell-tale housing 207 may include a slot 213, providing for movement of rotary actuator 210 with tell-tale rod 209. Rotary actuator 210 may be configured to rotate the piston assembly 206 and/or running tool 216, such as to engage or disengage a wellbore component, such as describe above with respect to FIG. 1, for example.

Linear actuator 201 may include, among other components not labeled, a linear actuator housing 214 within which is a piston assembly 206, which may include a piston 215, tell-tale rod 209, and a piston stem 217. Linear actuator 201 may further include an ROV panel 232, and may terminate at a lower end at bonnet 219. The linear actuator housing 214 may be coupled to the tell-tell housing 207 via the housing adapter 211.

The piston 215 may be connected to the tell-tale rod 209 and the piston stem 217. The piston stem, in turn, may be connected at a lower end to a running tool 216 disposed within the spool assembly 204.

Spool assembly 204 may include, among other components not labeled, an upper connector (bonnet connection) 236, spool housing 234, and a lower connector 238. Spool assembly 238 may also include an ROV panel 221.

In the embodiment as illustrated in FIGS. 2*a* and 2*b*, the hose management system 220 may include hydraulic hoses connecting to hydraulic lines residing in the tell-tale rod 209 and piston stem 217 to provide fluid to actuate running tool 216.

The running tool 216 may be configured to engage with an internal tree cap 250 or other wellbore element or tool (not shown). When the piston assembly 206 is retracted, the running tool 216 and any attached components, such as an internal tree cap 250, may be disposed within the spool housing 234. Extension of tell-tale rod 207 and piston stem 217 may thus extend running tool 216 and any attached tools or components into an out of spool assembly 204, and may be used to position the running tool within the Christmas tree 152 (FIG. 1).

The upper end of the open water lubricator may be capped by an upper connector 226, which may allow the open water lubricator 202 to be connected to a crane hook (not shown) or other tool for positioning subsea components, for example. The crane hook may be deployed from a vessel to position the open water lubricator 202 or a cap replacement system which includes the open water lubricator 202.

ROV panels 232, 221 may be disposed on the linear actuator housing 230 and spool assembly 204, respectively. ROV panels 232, 221 may allow elements of the open water lubricator to be controlled by an ROV.

The lower connector 238 may be configured to connect the open water lubricator 202 to a well control package 104, such as shown in FIG. 1, or directly to a Christmas tree 152. The lower connector 238 may be hydraulically or mechanically actuated, such that it may be locked onto the well control package 104.

The above described cap removal system may be used in a method of removing an internal tree cap from a subsea Christmas tree, such as illustrated in FIGS. 3*a*-3*e*, and a method of installing a new internal tree cap in a subsea Christmas tree, such as illustrated in FIGS. 4*a*-4*f*. While the configuration of the cap replacement system 300 shown in FIGS. 3*a*-4*f* is similar to that as described above with respect to FIG. 1; a cap replacement system similar to that as described above with respect to FIG. 2, such as including a tell-tale assembly, may also be used.

During the removal of an internal tree cap and the installation of a new internal tree cap, at least two verifiable pressure barriers might be maintained within a central bore of the cap replacement system and a central bore of the Christmas tree. A verifiable pressure barrier may be a barrier within one of the bores that maintains pressure on one side and does not allow the pressure to be transferred to the other side of the barrier. Further, a verifiable pressure barrier is configured such that it may be tested to determine the pressure on each side of the barrier, to determine whether or not the barrier is allowing a transfer of pressure thereacross. Verifiable pressure barriers are an important safety feature of wellhead environments. Having more than one verifiable pressure barrier provides redundancy, such that if one barrier fails, the other barrier may prevent the transfer of pressure out of or into a wellbore. A verifiable pressure barrier may also be referred to as a testable pressure barrier.

Figure 3A:
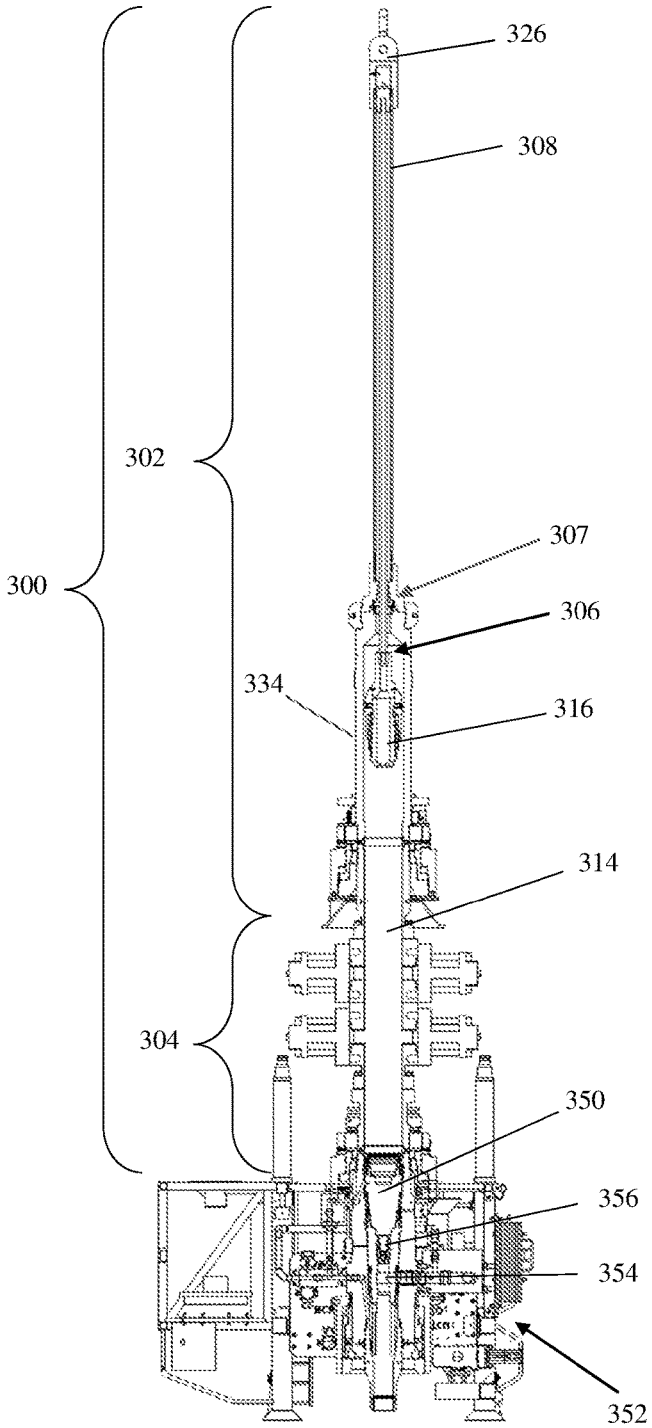
FIGS. 3*a*-3*e* are schematic views of a cap replacement system in accordance with the present disclosure, operating to remove an internal tree cap.

FIG. 3*a* illustrates a cap replacement system 300 landed on a subsea Christmas tree 352. An internal tree cap 350 is located in a central bore 354 of the Christmas tree 352. The internal tree cap 350 may be engaged with the central bore 354 of the Christmas tree 352 in such a way that it is capable of remaining in position under wellbore operating conditions, which may include high pressures and temperatures.

The configuration shown in FIG. 3*a* may be achieved by landing the cap replacement system 300 on the subsea Christmas tree 352 using a tool operated from a vessel (not shown), such as a crane or similar tool. The tool may be connected to an upper connector 326 of the cap replacement system 300 while the cap replacement system 300 is being lowered to the level of the Christmas tree 352 and positioned thereon. The tool may be disconnected from the upper connector 326 after the cap replacement system 300 is in a desired position. The well control package 304 of the cap replacement system 300 may be locked onto the Christmas tree 352. The locking may be performed using any means known in the art. The piston assembly 306 of the cap replacement system 300 may be in a retracted configuration such that the piston assembly 306 and the running tool 316 are within the open water lubricator 302.

The central bore 354 of the Christmas tree 352 and the central bore 314 of the cap replacement system 300 may include three testable pressure barriers, as well as RAMs from well control package 304 as a backup. A primary barrier may be formed by a lower crown plug 356 installed in the central bore 354 of the Christmas tree 352. A secondary barrier may be formed by the internal tree cap 350. A tertiary barrier may be formed by the cap replacement system 300, from the level of the bonnet 307 to the internal tree cap 350. The seals formed by the lower crown plug 356, the internal tree cap 350, and the seals in bonnet 307 of the cap replacement system 300 may be tested.

Figure 3B:
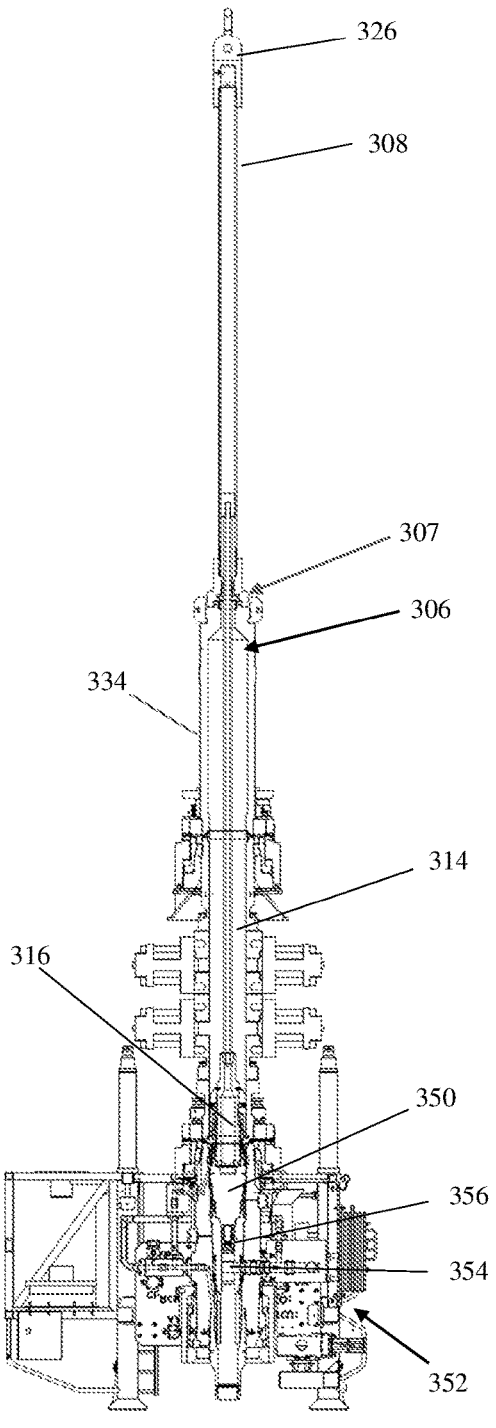

As shown in FIG. 3*b*, the piston assembly 306 may be extended through the well control package 304, such that the running tool 316 contacts the internal tree cap 350. The piston assembly 306 may be extended by the actuator 308. The running tool 316 may be rotated to align to internal tree cap 350 and may be latched to the internal tree cap 350. In some embodiments, the internal tree cap 350 may be a solid body internal tree cap. The latching may be performed by any means known in the art.

The piston assembly 306 may be retracted with sufficient force to unlock the internal tree cap 350 from the central bore 354 of the Christmas tree 352. The actuator 308 may retract the piston assembly 306. An intensifier device (not shown) may be used to increase the force which the actuator 306 may transfer to the running tool 316 through the piston assembly 306.

Figure 3C:
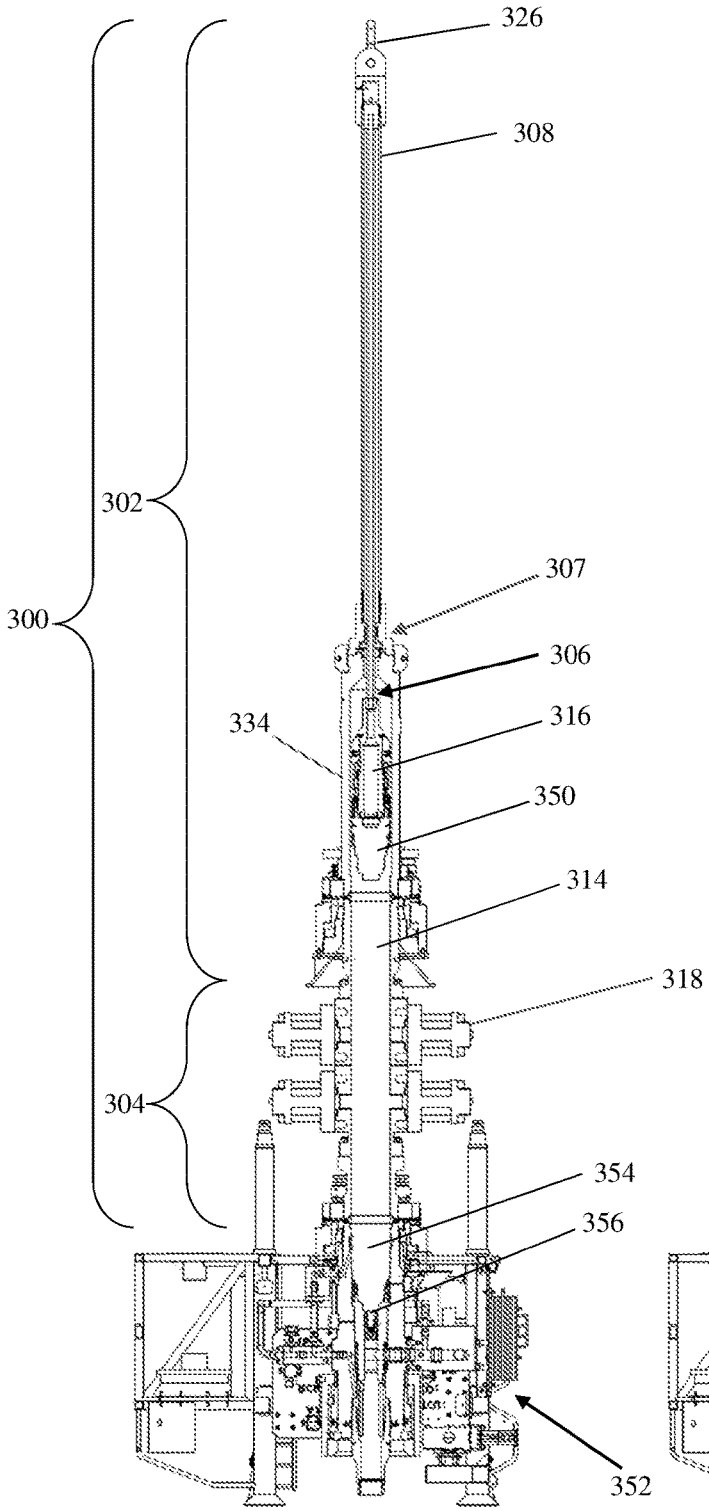

As shown in FIG. 3*c*, the piston assembly 306 may be fully retracted such that the piston assembly 306, the running tool 316, and the internal tree cap 350 are within the open water lubricator 302. The piston assembly 306 may be retracted using the actuator 308. The internal tree cap 350 may be located within the spool 334 of the open water lubricator 302.

At this point, the central bore 354 of the Christmas tree 352 and the central bore 314 of the cap replacement system 300 may include two testable pressure barriers. A primary barrier may be formed by a lower crown plug 356 installed in the central bore 354 of the Christmas tree 352. A secondary barrier may be formed by the central bores 314, 354 of the cap replacement system 300 and the Christmas tree 352, from the level of the bonnet 307 to the lower crown plug 356.

Figure 3D:
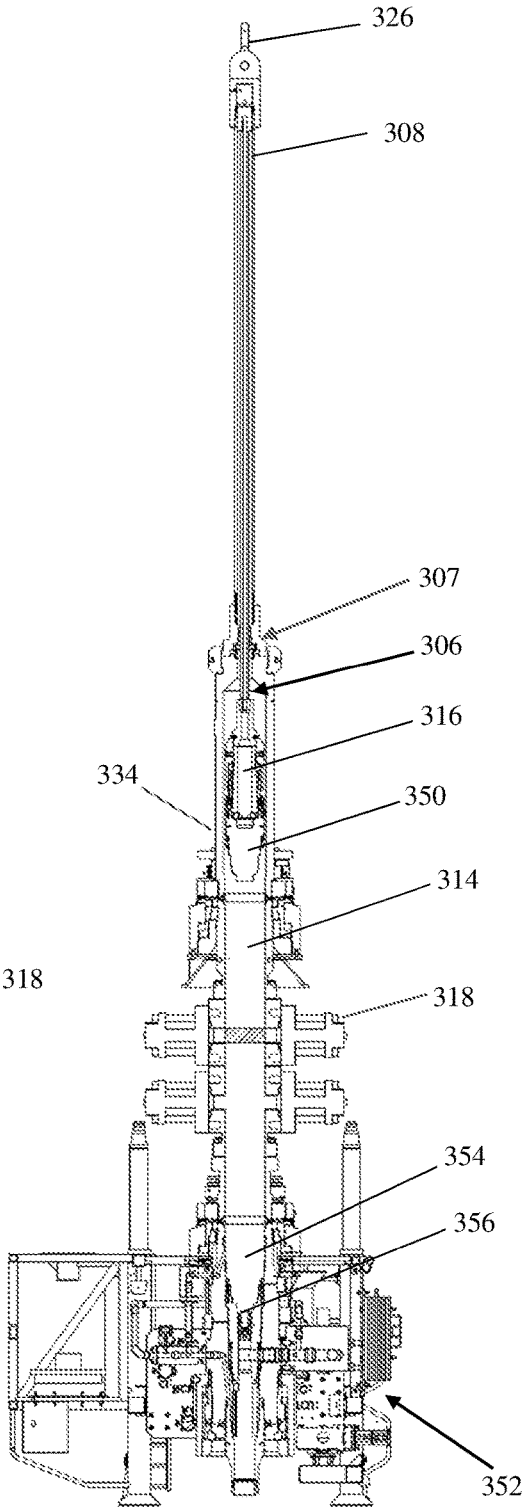

As shown in FIG. 3*d*, a valve 318 in the well control package 304 may be closed. The central bore 354 of the Christmas tree 352 and the central bore 314 of the cap replacement system 300 may include three testable pressure barriers. A primary barrier may be formed by a lower crown plug 356 installed in the central bore 354 of the Christmas tree 352. A secondary barrier may be formed by valve 318. A tertiary barrier may be formed by the central bore 314 of the cap replacement system 300, from the level of the bonnet 307 to the valve 318.

Figure 3E:
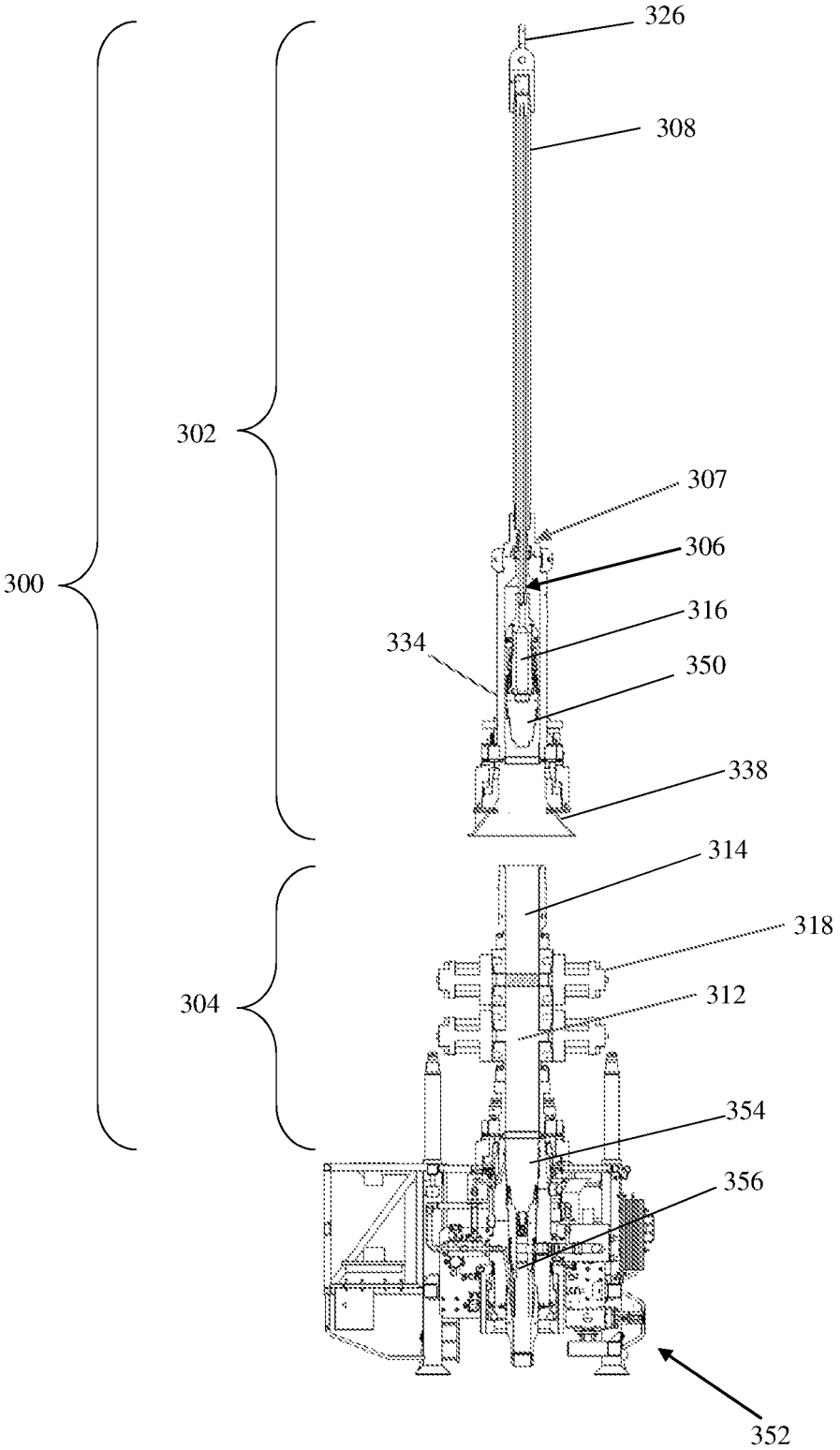

As shown in FIG. 3*e*, the open water lubricator 302 may be disconnected from the well control package 304. The open water lubricator 302 may contain the piston assembly 306, the running tool 316, and the internal tree cap 350. After the open water lubricator 302 is disconnected, it may be removed from the well control package 304 using a tool run from a vessel, such as a crane hook. The tool may be connected to the upper connector 326 of the open water lubricator 302. The open water lubricator 302 may be brought to a vessel. The internal tree cap may be retrieved from the open water lubricator 302 and the open water lubricator 302 may be reset with a new internal tree cap 450 (described below with respect to FIGS. 4*a*-4*f*) to be installed in the subsea Christmas tree 352. In some embodiments, the running tool 316 may be replaced with a new running tool (not shown) configured to attach to the new internal tree cap. In some embodiments, the running tool 316 may not be replaced, such as where the solid internal tree cap and the new internal tree cap may have similar attachment mechanisms.

At this point, two testable pressure barriers remain in the central bore 354 of the Christmas tree 352 and the central bore 312 of the well control package 304. A primary barrier may be formed by a lower crown plug 356 installed in the central bore 354 of the Christmas tree 352. A secondary barrier may be formed by the well control package 304 and the Christmas tree 352, within bores 312, 354, from the level of the closed valve 318 to the lower crown plug 356.

A wellbore intervention may optionally be performed prior to installation of the new tree cap. A riserless light well intervention stack (not shown) may be landed on and secured to the well control package 304. The valve 318 of the well control package 304 may be opened. The wellbore intervention may be performed. The valve 318 of the well control package 304 may be closed. The riserless light well intervention stack may be disconnected and removed from the well control package 304.

Following the removal of an internal tree cap 350, a new internal tree cap 450 may be installed in the subsea Christmas tree 352, as illustrated in FIGS. 4*a*-4*f*.

Figure 4A:
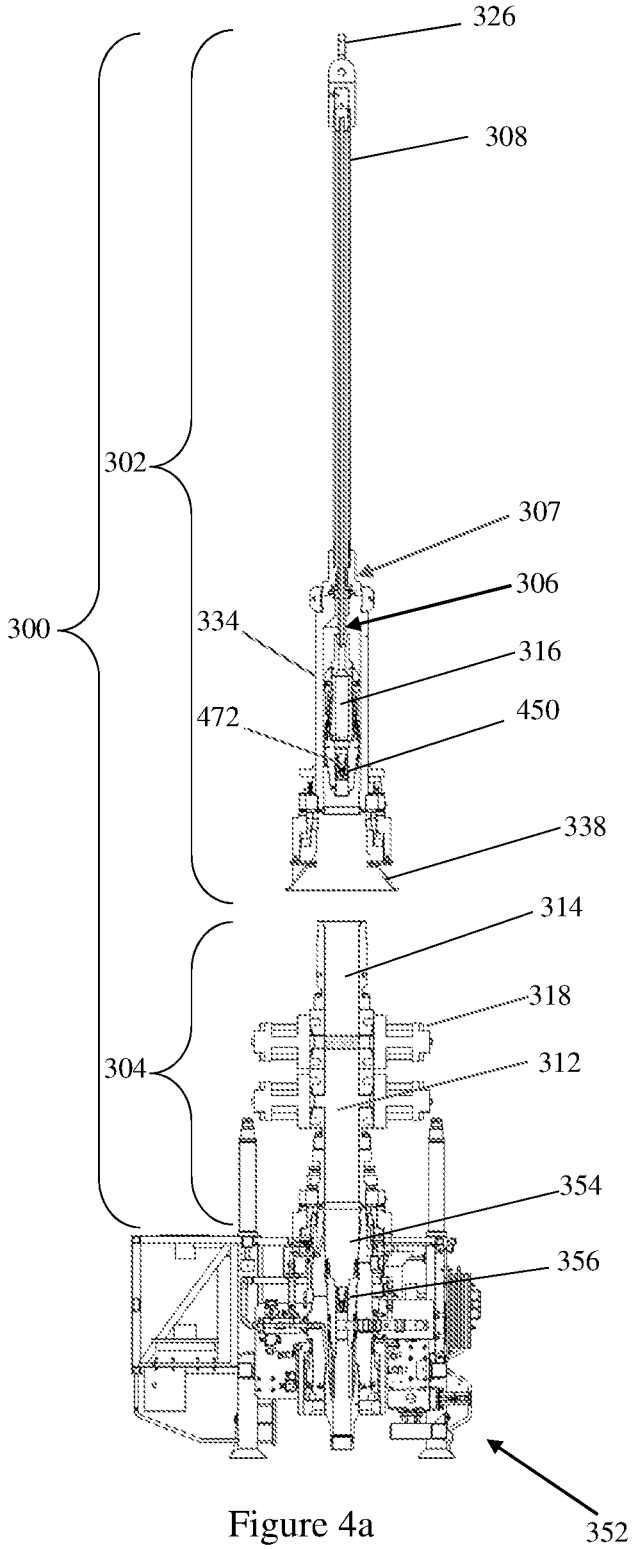
FIGS. 4*a*-4*f* are schematic views of a cap replacement system in accordance with the present disclosure, operating to install an internal tree cap.

As illustrated in FIG. 4*a*, the well control package 304 may remain disposed on and secured to the subsea Christmas tree 352. A valve 318 in the well control package 304 capable of closing the central bore 314, may be closed.

An open water lubricator 302 may be configured such that it contains a piston assembly 306 which may be actuated by an actuator 308. An end of the piston assembly 306 may include a running tool which may be configured to engage with an internal tree cap 450. An internal tree cap 450 may be attached to the running tool 316. The attachment of the internal tree cap 450 to the running tool 316 may be performed by any means known in the art. In some embodiments, the attachment mechanism may be reversible, such that the internal tree cap 450 may be attached to and removed from the running tool 316.

In some embodiments, the internal tree cap 450 may include an access bore in which a crown plug 472 may be disposed. The crown plug 472 may be installed in the internal tree cap 450 before or after the internal tree cap 450 is installed in the subsea Christmas tree 352. If it is not desired to perform a wellbore intervention after installation of the internal tree cap 450, the crown plug 472 may be installed in the internal tree cap 450 prior to installation of the internal tree cap 450.

The open water lubricator 302, including the new internal tree cap, may be deployed to a subsea location and landed on the well control package 304 using a tool controlled from a vessel, such as a crane hook. The tool may be attached to the upper connecter 326 of the open water lubricator 302.

Figure 4B:
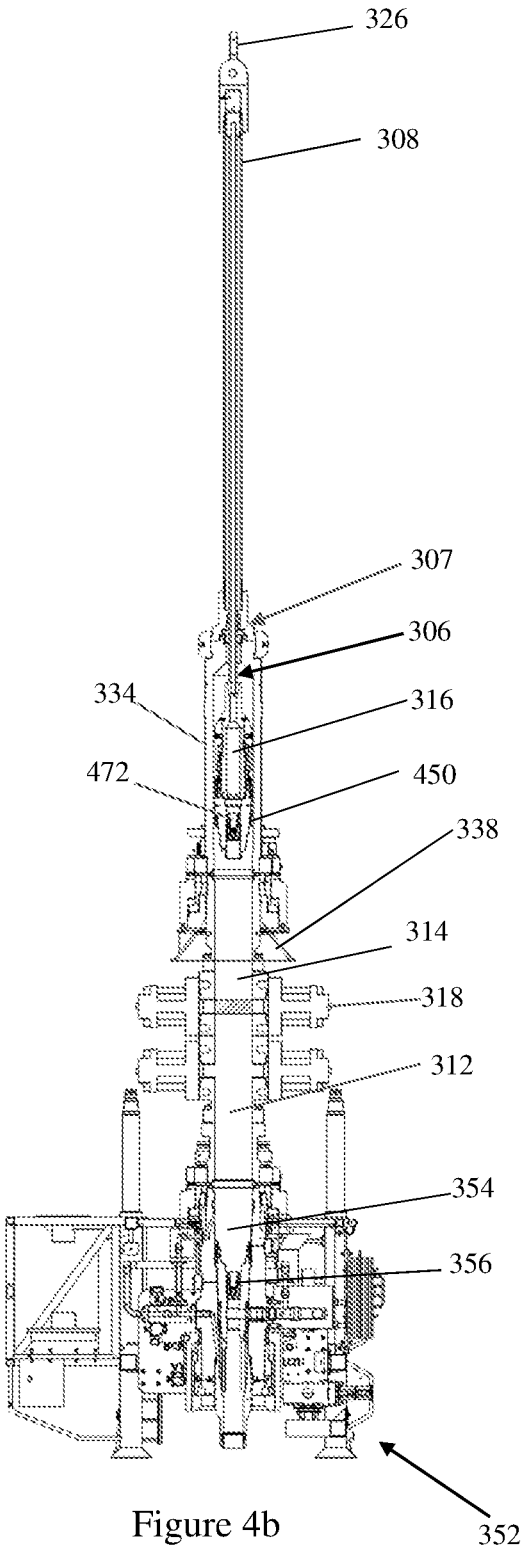

As shown in FIG. 4*b*, the open water lubricator 302 may be installed on the well control package 304. The open water lubricator 302 may be secured to the well control package 304 via the lower connector 338 using any means known in the art. The open water lubricator 302 and the well control package 304 may form the cap replacement system 300.

After connection of the open water lubricator 302, the central bore 354 of the Christmas tree 352 and the central bore 314 of the cap replacement system 300 may include three testable pressure barriers. A primary barrier may be formed by a lower crown plug 356 installed in the central bore 354 of the Christmas tree 352. A secondary barrier may be formed by valve 318. A tertiary barrier may be formed by the central bore 314 of the cap replacement system 300, from the level of the bonnet 307 to the valve 318. The seals formed by the cap replacement system 300, the valve 318, and the lower crown plug 356 may be tested.

Figure 4C:
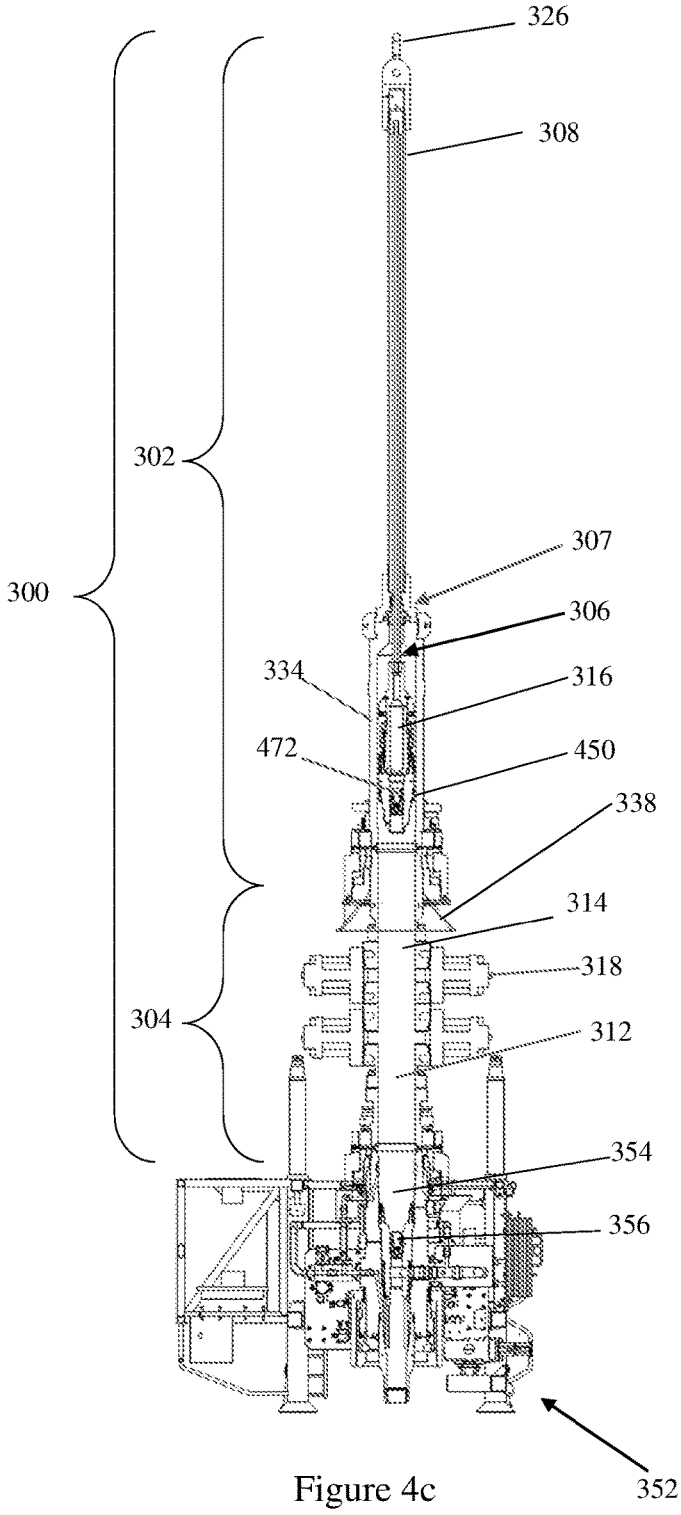

As shown in FIG. 4*c*, the valve 318 of the well control package 304 may be opened to provide access to the Christmas tree for installation of the new internal tree cap 450. At this stage of the operation, the central bore 354 of the Christmas tree 352 and the central bore 314 of the cap replacement system 300 may include two testable pressure barriers. A primary barrier may be formed by a lower crown plug 356 installed in the central bore 354 of the Christmas tree 352. A secondary barrier may be formed by the central bores 314, 354 of the cap replacement system 300 and the Christmas tree 352, from the level of the bonnet 307 to the lower crown plug 356.

Figure 4D:
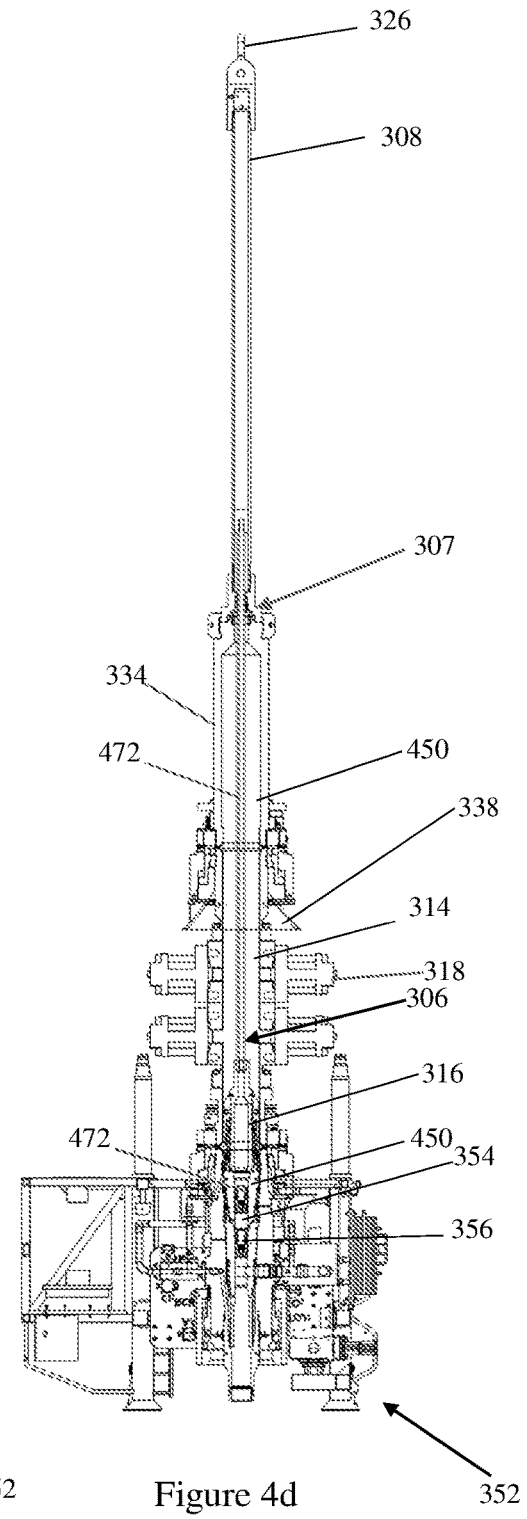

As shown in FIG. 4*d*, the piston assembly 306 may be lowered through the well control package 302 such that the internal tree cap 350 is located at a desired position in the central bore 354 of the Christmas tree 352. The internal tree cap 450 may be locked into this position using any means known in the art. In some embodiments, the actuator 308 may apply force to the internal tree cap 450 via the piston assembly 306 and the running tool 316 to lock the internal tree cap 450 into position. The force applied may be multiplied by an intensifier device (not shown). In some embodiments, the internal tree cap 450 and the central bore 354 may include a mechanical locking mechanism. The seal formed by the internal tree cap 450 may be tested.

Figure 4E:
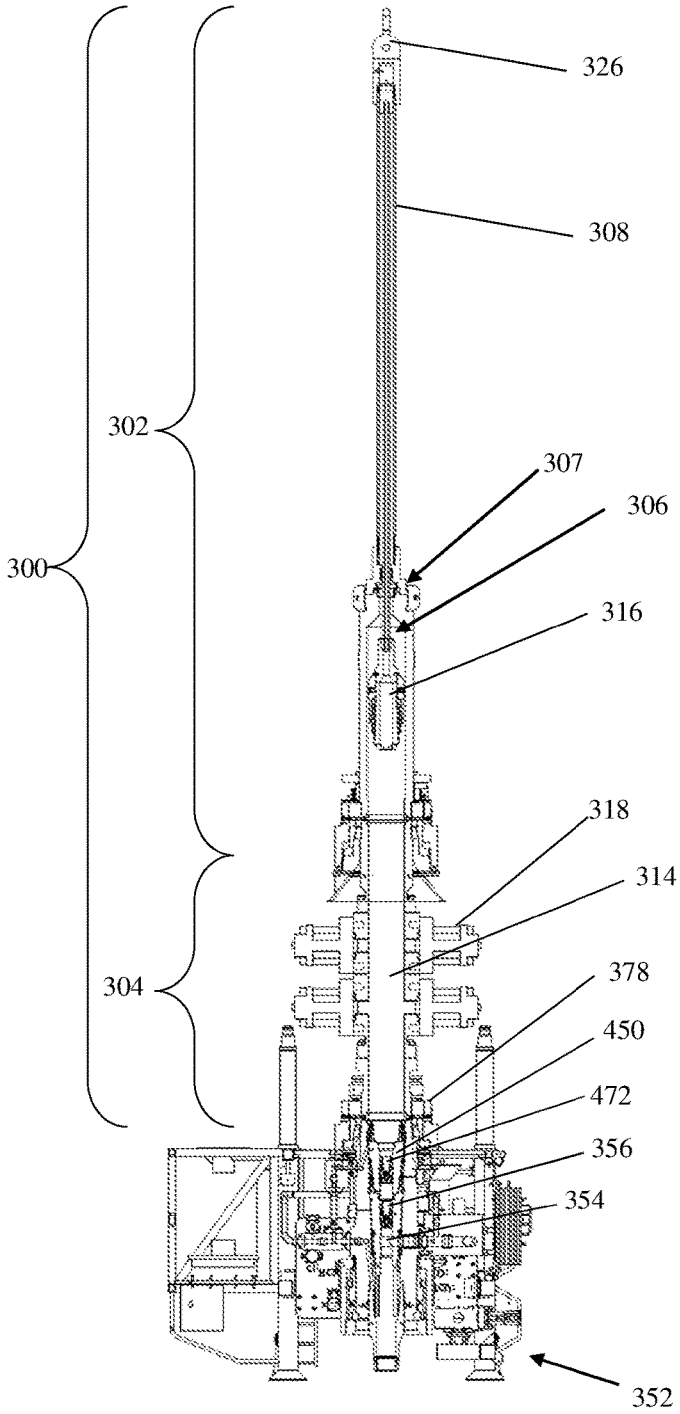

As shown in FIG. 4*e*, following installation of the internal tree cap 450, the running tool 316 may be disconnected from the internal tree cap 450 and the piston assembly 306 may be retracted. The running tool 316 may be disconnected from the internal tree cap 450. The internal tree cap 450 may remain in the central bore 354 of the Christmas tree 352. The piston assembly 306 may be retracted by the actuator 308, such that the piston assembly 306 and the running tool are within the open water lubricator 302.

At this point in the process, the central bore 354 of the Christmas tree 352 and the central bore 314 of the cap replacement system 300 may include three testable pressure barriers. A primary barrier may be formed by a lower crown plug 356 installed in the central bore 354 of the Christmas tree 352. A secondary barrier may be formed by the internal tree cap 450. A tertiary barrier may be formed by the central bore 314 of the cap replacement system 300, from the level of the bonnet 307 to the internal tree cap 450. The seals formed by the lower crown plug 356, the internal tree cap 450, and the central bore 314 of the cap replacement system 300 may be tested.

If the internal tree cap 450 includes an access bore, but does not have a crown plug 472 installed therein, the internal tree cap 450 may not form the secondary barrier, but a secondary barrier will be formed by the central bore 354 of the Christmas tree 352 and the central bore 314 of the cap replacement system 300 from the level of the bonnet 307 to the lower crown plug 472. Alternatively, the valve 318 may be closed to form the secondary pressure barrier.

Figure 4F:
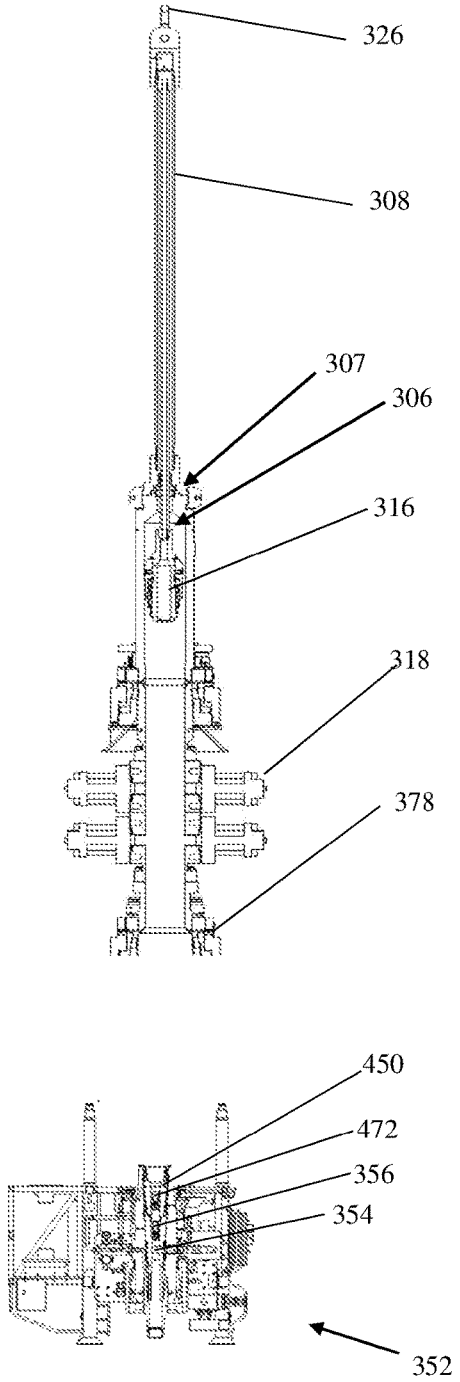

As shown in FIG. 4*f*, the cap replacement system 300 may be removed from the Christmas tree 352 when there are two testable pressure barriers formed by the lower crown plug 356 installed in the central bore 354 of the Christmas tree 352 and a secondary barrier may be formed by the internal tree cap 450. A connector 378 may be disconnected from the Christmas tree 352. After the cap replacement system 300 is disconnected, it may be removed using a tool run from a vessel. The tool may be connected to the upper connector 326 of the open water lubricator 302. The cap replacement system may be brought to a vessel.

In some embodiments, the open water lubricator 302 may be disconnected from the well control package 304 when there are two testable pressure barriers formed by the lower crown plug 356 installed in the central bore 354 of the Christmas tree 352 and a secondary barrier may be formed by the valve 318. The open water lubricator 302 may contain the piston assembly 306 and the running tool 316. After the open water lubricator 302 is disconnected, it may be removed from the well control package 304 using a tool run from a vessel. The tool may be connected to the upper connector 326 of the open water lubricator 302. The open water lubricator 302 may be brought to a vessel.

A wellbore intervention may optionally be performed. A riserless light well intervention stack (not shown) may be landed on and secured to the well control package 304. The valve 318 may be opened. If a crown plug 472 is installed in the internal tree cap 450, the crown plug 472 may be removed. The lower crown plug 356 may be removed. The wellbore intervention may be performed. The internal tree cap 450 may remain installed during the wellbore intervention. After the intervention is completed, the lower crown plug 356 may be reinstalled. The crown plug 472 may be installed or reinstalled in the internal tree cap 450. The riserless light well intervention stack may be disconnected and removed from the well control package 304. The well control package 304 may be removed from the Christmas tree 352.

After removal of the well control package 304, the Christmas tree 352 may include two testable pressure barriers. A primary barrier may be formed by the lower crown plug 356. A secondary barrier may be formed by the internal tree cap 450 and the installed crown plug 472. The primary and secondary barriers may be tested.

The system and method disclosed herein may have advantages over traditional systems and methods for replacing internal tree caps in subsea Christmas trees. The current state of the art involves deploying a blowout preventer, a marine riser, and a landing string from a rig. The marine riser remains connected to the rig throughout the removal of an old internal tree cap and the installation of a new internal tree cap. In contrast, the system of the present disclosure may be deployed from a vessel which is smaller than a rig and the disclosed method may be performed without having the system connected to the vessel. Therefore, the system and method disclosed herein may reduce the time, money, and personnel required to replace an internal tree cap and may reduce the risk of damage to the wellhead from fatigue during the replacement. The system and method may further provide greater flexibility in replacement opportunities by eliminating the requirement for the use of a rig.

The system and method disclosed herein may provide further advantages by replacing solid body internal tree caps with internal tree caps having access bores. Internal tree caps having access bores may reduce the time and cost of performing future wellbore interventions and allow smaller equipment to be used. Internal tree caps having access bores may allow wellbore interventions to be performed after removal of a crown plug from the internal tree cap, and may not require removal of the internal tree cap.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A system comprising:

an open water lubricator having a piston assembly disposed therein, wherein the open water lubricator comprises:

an upper assembly comprising:

a tell-tale assembly, wherein the tell-tale assembly comprises:

a housing;

a tell-tale rod disposed within the housing;

a rotary actuator configured to rotate at least one of the piston assembly and a running tool; and a hose management system; and a linear actuator assembly connected to the tell-tale assembly; and a lower spool assembly connected to the linear actuator assembly; and a well control package connected to a distal end of the open water lubricator, wherein the piston assembly is configured to extend through the well control package.

2. The system of claim 1, wherein the running tool is configured to engage with a wellbore element, and wherein the piston assembly is connected to the running tool.

3. The system of claim 2, wherein the wellbore element comprises at least one of an internal tree cap and a crown plug.

4. The system of claim 1, wherein an interior of the system comprises a verifiable pressure barrier.

5. The system of claim 1, wherein the system comprises a connector configured to attach to a subsea Christmas tree.

6. The system of claim 1, wherein the upper assembly comprises at least one of internal hydraulic lines and external hydraulic lines, and a hydraulic manifold is configured for one or more methods of providing movement of the tell-tale rod or actuating the running tool connected directly or indirectly to the tell-tale rod.

7. The system of claim 1, wherein the linear actuator assembly comprises: a linear actuator housing, a piston disposed within the actuator housing and connected to a lower end of the tell-tale rod, and a piston stem connected to the piston, wherein the piston stem extends into the lower spool assembly.

8. The system of claim 1, wherein the lower spool assembly is configured to be connected to a subsea Christmas tree or the well control package.

9. The system of claim 1, wherein the well control package comprises at least one valve configured to seal a central bore of the system.

10. A method of performing a wellbore operation, comprising:

engaging a cap replacement system with a subsea Christmas tree; the cap replacement system comprising:

an open water lubricator having a piston disposed therein; and a well control package connected to a distal end of the open water lubricator, wherein the open water lubricator comprises:

an upper assembly, comprising:

a tell-tale assembly wherein the tell-tale assembly comprises:

a housing;

a tell-tale rod disposed within the housing;

a rotary actuator configured to rotate at least one of the piston assembly and a running tool; and a hose management system; and a linear actuator assembly connected to the tell-tale assembly; and a lower spool assembly connected to the linear actuator assembly;

withdrawing a first internal tree cap from the subsea Christmas tree into the open water lubricator;

closing a valve in the well control package;

removing the open water lubricator containing the piston and the first internal tree cap;

removing the first internal tree cap from the open water lubricator;

installing a second internal tree cap in the open water lubricator;

connecting the open water lubricator to the well control package;

opening the valve in the well control package;

disposing the second internal tree cap within the subsea Christmas tree; and removing the open water lubricator and the well control package from the subsea Christmas tree.

11. The method of claim 10, wherein the step of withdrawing a first internal tree cap from the subsea Christmas tree into the open water lubricator comprises:

extending the piston into the subsea Christmas tree;

engaging the running tool connected to the piston with a first internal tree cap;

removing the first internal tree cap from the subsea Christmas tree; and retracting the piston, the running tool, and the first internal tree cap into the open water lubricator.

12. The method of claim 10, wherein the step of disposing the second internal tree cap within the subsea Christmas tree comprises:

extending the piston and the running tool with the second internal tree cap disposed thereon into the subsea Christmas tree;

installing the second internal tree cap in the subsea Christmas tree;

disengaging the running tool from the second internal tree cap; and retracting the piston into the open water lubricator.

13. The method of claim 10, further comprising disconnecting the cap replacement system from a vessel and performing at least part of the operation while the cap replacement system is not connected to the vessel.

14. The method of claim 10, further comprising performing a seal verification test on the internal tree cap, the cap replacement system, and optionally, a lower crown plug disposed in the wellhead.

15. The method of claim 10, further comprising performing a wellbore operation after removing the first internal tree cap, the wellbore operation comprising:

engaging a riserless light well intervention stack with the well control package;

opening the valve in the well control package;

retrieving a lower crown plug disposed in the subsea Christmas tree;

performing a wellbore intervention;

replacing the lower crown plug;

closing the valve in the well control package; and removing the riserless light well intervention stack.

16. The method of claim 10, wherein the first internal tree cap is a solid body internal tree cap and the second internal tree cap is an internal tree cap, which includes an access bore formed therethrough.

17. The method of claim 10, further comprising maintaining at least two verifiable pressure barriers throughout the wellbore operation.

18. The method of claim 10, further comprising performing a seal verification test on one or more of the internal tree cap, the cap replacement system, the valve, and a lower crown plug disposed in the wellhead.

19. The method of claim 10, further comprising performing a wellbore operation after disposing the second internal tree cap in the subsea Christmas tree, the wellbore operation comprising:

engaging a riserless light well intervention stack with the well control package;

opening the valve in the well control package;

retrieving a lower crown plug disposed in the subsea Christmas tree;

performing a wellbore intervention;

replacing the lower crown plug;

installing a crown plug in the second internal tree cap;

closing the valve in the well control package; and removing the riserless light well intervention stack from the well control package.

20. A method comprising:

removing a solid body internal tree cap from a subsea wellhead using the system of claim 1; and installing an internal tree cap having an access bore formed therethrough in a subsea wellhead, wherein the method is performed while maintaining at least two testable pressure barriers during each of the removing and installing steps.

21. The method of claim 20, further comprising performing a wellbore intervention before installing the internal tree cap having the access bore formed therethrough.

22. The method of claim 20, further comprising performing a wellbore intervention after installing the internal tree cap having the access bore formed therethrough.

23. An open water lubricator, comprising:

an upper assembly comprising:

an outer housing; and a tell-tale assembly configured to provide rotary movement, the tell-tale assembly comprising:

a housing;

a tell-tale rod disposed within the housing;

a rotary actuator configured to rotate at least one of the piston assembly and a running tool; and a hose management system;

a lower spool assembly connected to a linear actuator assembly; and a piston assembly at least partially disposed within the upper assembly and the lower spool assembly, wherein the piston assembly comprises:

a piston disposed within the outer housing of the upper assembly; and a piston stem connected to the piston, the piston stem extending into the lower spool assembly;

wherein the piston assembly is configured to linearly translate the piston within the outer housing and to translate the piston stem through the lower spool assembly, and wherein the piston assembly is connected to the tell-tale assembly.

24. The lubricator of claim 23, wherein the upper assembly further comprises internal and/or external hydraulic lines and a hydraulic manifold is configured for one or more methods of providing linear translation of the piston assembly, movement of the tell-tale rod, or actuation of a running tool connected directly or indirectly to the tell-tale rod or the piston stem.

* * * * *